US010205281B2

(12) United States Patent
Preuss et al.

(10) Patent No.: US 10,205,281 B2
(45) Date of Patent: Feb. 12, 2019

(54) APPARATUS FOR RETAINING A PLUG WITHIN A RECEPTACLE

(71) Applicant: PCE, Inc., Lincoln, NE (US)

(72) Inventors: Jesse Preuss, Lincoln, NE (US); Jeff Micek, Lincoln, NE (US); Matt Dageforde, Lincoln, NE (US)

(73) Assignee: Vertiv Corporation, Columbus, OH (US)

( * ) Notice: Subject to any disclaimer, the term of this patent is extended or adjusted under 35 U.S.C. 154(b) by 0 days.

(21) Appl. No.: 15/710,409

(22) Filed: Sep. 20, 2017

(65) Prior Publication Data

US 2018/0083387 A1 Mar. 22, 2018

Related U.S. Application Data

(60) Provisional application No. 62/397,208, filed on Sep. 20, 2016.

(51) Int. Cl.
*H01R 13/639* (2006.01)
*H01R 13/635* (2006.01)
(Continued)

(52) U.S. Cl.
CPC ..... *H01R 13/635* (2013.01); *H01R 13/6271* (2013.01); *H01R 13/6275* (2013.01);
(Continued)

(58) Field of Classification Search
CPC ..... H01R 13/635; H01R 13/6275; H01R 13/6392; H01R 13/639; H01R 24/28
(Continued)

(56) References Cited

U.S. PATENT DOCUMENTS 4,618,200 A 10/1986 Roberts et al.
4,917,625 A * 4/1990 Haile ..... H01R 13/639 439/358
(Continued)

FOREIGN PATENT DOCUMENTS

WO 9208259 A1 5/1992
WO 2013036966 A2 3/2013

OTHER PUBLICATIONS

Tripp Lite PDU Plug Lock Connector C14 Power Cord to C13 Outlet Red 100PK. Mfg. Part: PLC13RD, COW Part: 3070678, Printed online at: www.cdw.com.
(Continued)

*Primary Examiner* — Tulsidas C Patel
*Assistant Examiner* — Peter G Leigh
(74) *Attorney, Agent, or Firm* — Suiter Swantz pc llo

(57) ABSTRACT

The apparatus for retaining a plug within a receptacle may include a receptacle body and a release device. In one embodiment, the receptacle body may include at least one tab, and the at least one tab may include at least one barb. When a plug is inserted into the receptacle body, the plug may cause the at least one tab to extend toward an exterior side of the receptacle body while the at least one tab remains in contact with the plug. The plug may be retained within the receptacle body with the pressure applied by the at least one tab to the plug. In order to release the plug, the release device may come into contact with the at least one tab, cause the at least one tab to extend away from the plug, and allow the plug to be released from the receptacle body.

18 Claims, 12 Drawing Sheets

(51) Int. Cl.
*H01R 13/627* (2006.01)
*H01R 24/78* (2011.01)

(52) U.S. Cl.
CPC ..... *H01R 13/639* (2013.01); *H01R 13/6395* (2013.01); *H01R 24/78* (2013.01)

(58) Field of Classification Search
USPC ..... 439/369
See application file for complete search history.

(56) References Cited

U.S. PATENT DOCUMENTS 5,921,799 A 7/1999 Forrester
6,086,411 A * 7/2000 Shinozaki ..... H01R 13/5219 439/188
6,443,762 B1 * 9/2002 Lessig, III ..... H01R 13/639 439/373
6,688,907 B2 * 2/2004 Yamaoka ..... H01R 13/6272 439/188
6,769,930 B1 8/2004 McDevitt, Jr.
6,939,161 B1 9/2005 Yi et al.
7,014,493 B1 3/2006 Battard
7,101,213 B2 * 9/2006 Toyoda ..... H01R 13/6272 439/358
7,559,788 B2 7/2009 Legg
7,658,635 B2 * 2/2010 Gilchrist ..... H01R 13/639 439/357
7,722,380 B1 5/2010 West et al.
8,052,437 B2 11/2011 Jiang et al.
8,109,778 B2 2/2012 Howard et al.
8,469,734 B2 6/2013 Chen
8,956,177 B2 2/2015 Warner
8,968,015 B2 * 3/2015 Chang ..... H01R 13/639 439/135
9,225,110 B2 * 12/2015 Huang ..... H01R 13/6272
9,276,357 B2 3/2016 Hutchison et al.
9,735,502 B2 * 8/2017 Stevens ..... H01R 13/621
2002/0068477 A1 * 6/2002 Chen-Chiang ..... H01R 13/6395 439/373
2003/0207606 A1 11/2003 Ho
2006/0264087 A1 11/2006 Woellner et al.
2007/0032115 A1 2/2007 Takashita
2009/0117761 A1 5/2009 O'Connell et al.
2009/0137142 A1 * 5/2009 Xia ..... H01R 13/6395 439/350
2011/0237108 A1 9/2011 Vass
2012/0015541 A1 1/2012 Lu
2013/0109213 A1 * 5/2013 Chang ..... H01R 13/633 439/304
2013/0143428 A1 * 6/2013 Chang ..... H01R 13/6395 439/357
2013/0157495 A1 * 6/2013 Chang ..... H01R 13/6395 439/345
2013/0244468 A1 * 9/2013 Chang ..... H01R 13/6395 439/345
2015/0044900 A1 * 2/2015 Mcdowall ..... H01R 13/6275 439/372
2015/0104968 A1 * 4/2015 Hutchison ..... H01R 13/639 439/357
2015/0280362 A1 * 10/2015 Huang ..... H01R 13/6272 439/354
2015/0357758 A1 * 12/2015 Krietzman ..... H01R 13/639 439/345

OTHER PUBLICATIONS

C14SecureSieeve Contact Retention Insert for connecting a C14 into a C13 Yellow, Item#: 6820, Printed online at: www.stayonline.com.
PCT International Search Report for International Application No. PCT/US2017/052553 dated Nov. 28, 2017, 8 pages.

* cited by examiner

APPARATUS FOR RETAINING A PLUG WITHIN A RECEPTACLE

CROSS REFERENCE TO RELATED APPLICATIONS

The present application claims the benefit under 35 U.S.C. § 119 of U.S. Provisional Patent Application Ser. No. 62/397,208 filed Sep. 20, 2016. The U.S. Provisional Patent Application Ser. No. 62/397,208 filed Sep. 20, 2016 is hereby incorporated by reference in its entirety.

TECHNICAL FIELD

The present disclosure generally relates to the field of computing cables and power cables, and more particularly to an apparatus for retaining a plug within a receptacle.

BACKGROUND

Many electronic devices, particularly computer and data storage equipment, are supplied power from an alternating current (AC) power source. A typical power cord may include a cable, the cable including a first plug to connect to the AC power source and a second plug to connect to a receptacle of the electronic device. It is critical for the operation of the electronic device that it receive power to remain operational, particularly for data storage equipment. A problem with many electronic devices is the inadvertent disconnection of the plug of the power cord from the receptacle of the electronic device.

SUMMARY

Accordingly, the present disclosure is directed to an apparatus for retaining a plug within a receptacle. The apparatus for retaining a plug within a receptacle may include a receptacle body and a release device. In one embodiment, the receptacle body may include at least one tab, and the at least one tab may include at least one barb. The at least one tab, including the at least one barb may be located within an interior of the receptacle body. When a plug is inserted into the receptacle body, the plug may cause the at least one tab to extend toward an exterior side of the receptacle body while the at least one tab remains in contact with the plug. The plug may be retained within the receptacle body with the pressure applied by the at least one tab to the plug. In order to release the plug, the release device may come into contact with the at least one tab, cause the at least one tab to extend away from the plug, and allow the plug to be released from the receptacle body.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

Referring to FIGS. 1-12, an apparatus for retaining a plug within a receptacle according to various embodiments is shown. The apparatus for retaining a plug within a receptacle the present disclosure is directed to an apparatus for retaining a plug within a receptacle. The apparatus for retaining a plug within a receptacle may include a receptacle body and a release device. In one embodiment, the receptacle body may include at least one tab, and the at least one tab may include at least one barb. The at least one tab, including the at least one barb may be located within an interior of the receptacle body. When a plug is inserted into the receptacle body, the plug may cause the at least one tab to extend toward an exterior side of the receptacle body while the at least one tab remains in contact with the plug. The plug may be retained within the receptacle body with the pressure applied by the at least one tab to the plug. In order to release the plug, the release device may come into contact with the at least one tab, cause the at least one tab to extend away from the plug, and allow the plug to be released from the receptacle body.

Figure 1:
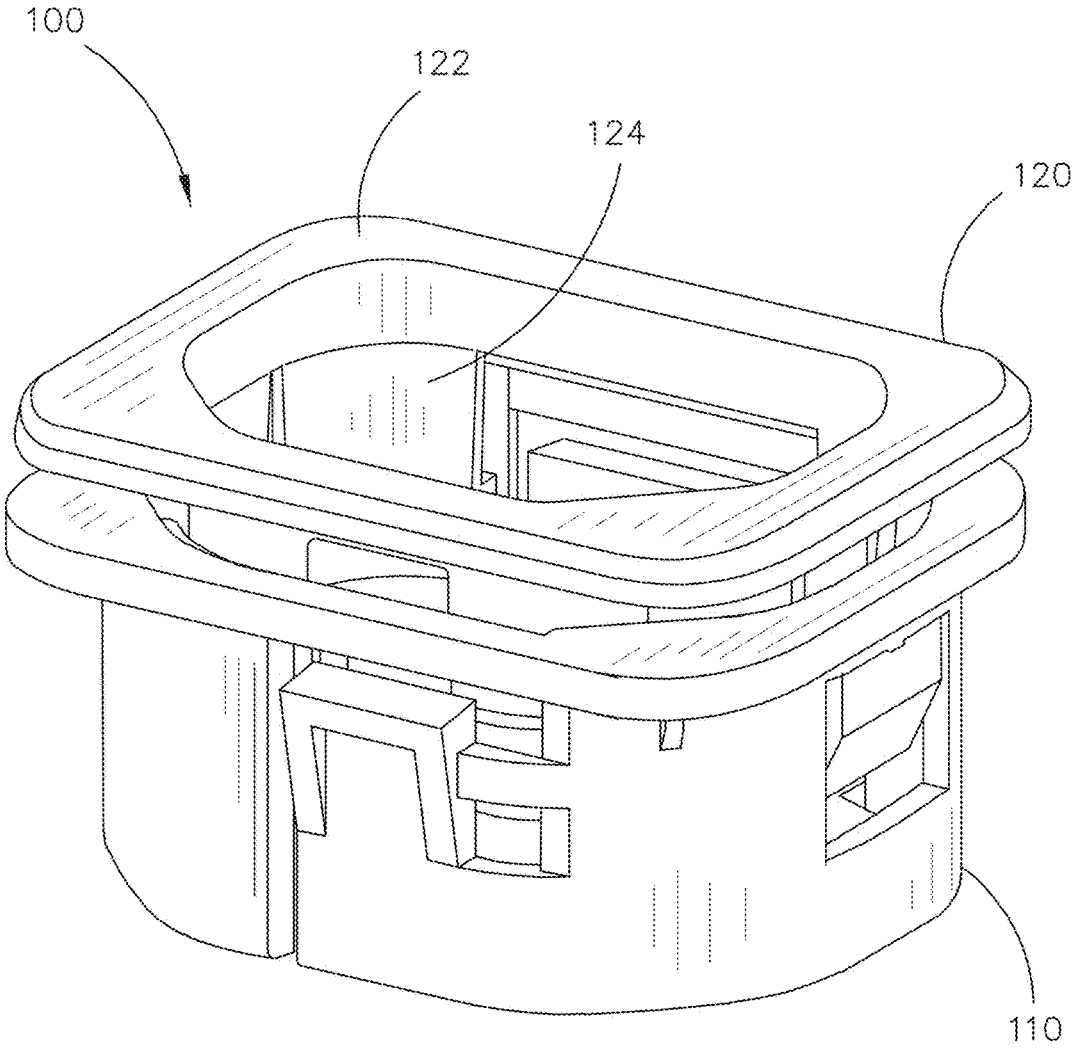
FIG. 1 depicts an apparatus for retaining a plug in a receptacle in accordance with an embodiment of the present disclosure.

Referring specifically to FIG. 1, an apparatus 100 for retaining a plug in a receptacle in accordance with an embodiment of the present disclosure is shown. Apparatus 100 for retaining a plug within a receptacle may include a receptacle body 110 and a release device 120. Receptacle body 110 may include at least one tab, and the at least one tab may optionally include at least one barb. Release device 120 may include a face portion 122 and at least one prong 124. Face portion 122, also referred as a front edge, rim, or bezel, may allow a user's fingers to depress the face portion 122 of the release device 120 which may cause the at least one prong 124 to come into contact with the at least one tab in order to allow a plug to be removed from the receptacle body 110.

Receptacle body 110 may include a receptacle, or may surround a receptacle. It is contemplated that receptacle may include a female electrical fitting. Alternately, it is further contemplated that receptacle may include a male electrical fitting, also referred and called an inlet mechanism as shown and further described in FIG. 9 which may connect to a connector as shown in FIG. 10.

Receptacle body 110 and release device 120 may be formed of a variety of rigid materials, including plastic, composites and metals. It is contemplated that plastic may be engineering grade and the plastic may be in compliance with local safety requirements. The at least one barb of receptacle body 110 may be formed of plastic in one embodiment of the disclosure. In an alternative embodiment, the at least one barb may be formed of metal, such as stainless steel. Additionally, it is contemplated that the barb may be formed of an elastomer material. The elastomer material may form a grip for a friction fit with the shroud of a plug. While the face portion 122 of the release device 120 may be formed of a hard plastic, such as a nylon plastic, the elastomer material may be softer and slightly compressible to allow a friction fit with a shroud of a plug. The elastomer material may be a thermoplastic elastomer (TPE) material. Additionally, the elastomer material may be acrylonitrile butadiene styrene, polycarbonate, polyethylene, or polypropylene.

Figure 2:
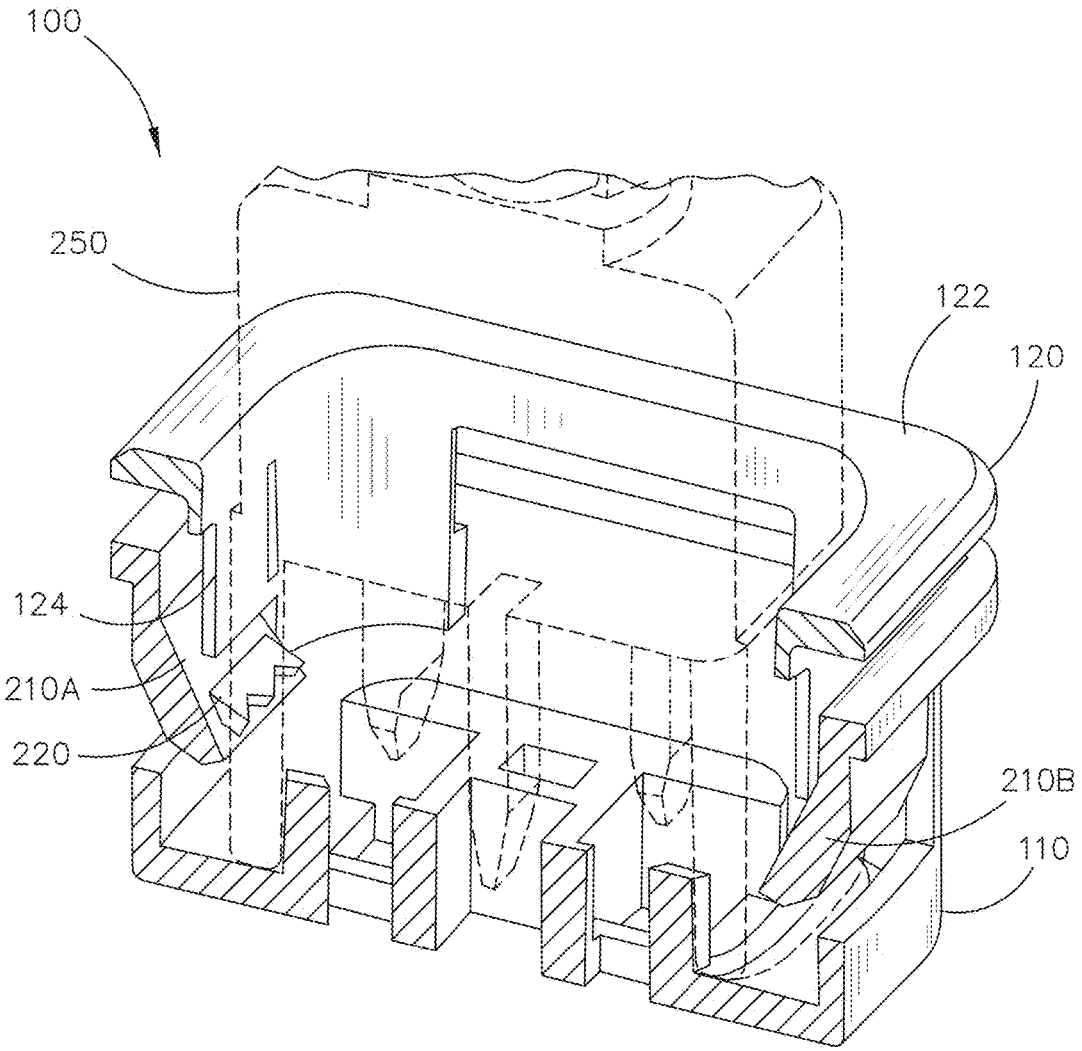
FIG. 2 depicts a cutaway view of an apparatus for retaining a plug in a receptacle in accordance with an embodiment of the present disclosure.

Referring to FIG. 2, a cutaway view of an apparatus 100 for retaining a plug in a receptacle in accordance with an embodiment of the present disclosure is shown. Receptacle body 110 may include at least one tab 210A, 210B. Tab 210A, 210B may be flexible. Tab 210A, 210B may include a barb 220. Barb 220 may refer to a projection extending from the at least one tab 210A, 210B which is configured to contact a shroud of a plug. When a plug 250 is inserted into the receptacle body 110, the insertion of the plug may cause the at least one tab 210A, 210B to extend toward an exterior side of the receptacle body 110 while the at least one tab remains in contact with the plug 250. It is contemplated that the plug 250 may be retained within the receptacle body 110 by pressure applied by the at least one tab 210A, 210B and barb 220, which may be referred as an interference fit or contact fit. While there are two tabs shown, it is contemplated that one, three, or four or more tabs may be employed without departing from the scope and intent of the present disclosure.

Figure 3:
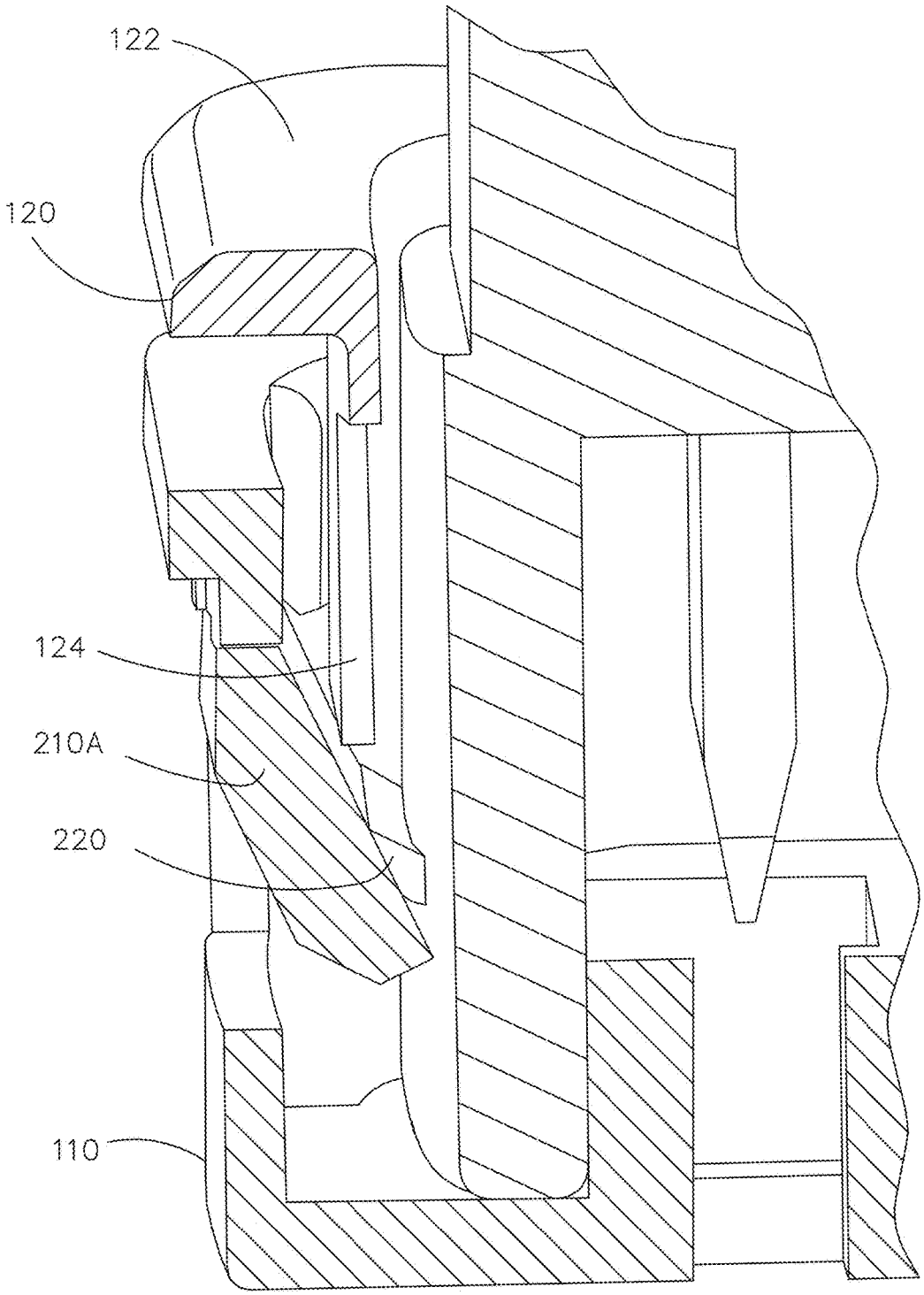
FIG. 3 depicts an exploded cutaway view of an apparatus for retaining a plug in accordance with an embodiment of the present disclosure.

FIG. 3 depicts an exploded cutaway view of an apparatus for retaining a plug in accordance with an embodiment of the present disclosure. To release a plug inserted within the receptacle body 110, the release device 120 is configured to be moved toward the interior of the receptacle body 110. The one or more prongs 124 of the release device 120 may contact the one or more tabs 210A to cause the one or more tabs 210A to extend away from the plug, at which point the plug can be removed from the receptacle body 110. It is contemplated that the one or more prongs 124 may contact the one or more tabs 210A to reduce the pressure applied by the one or more tabs 210A and may or may not remain in slight contact with the plug 250. However, with the reduced pressure applied by the one or more tabs 210A, plug 250 may be easily removed from the receptacle body 110. While barb 220 is shown as a jagged edge, it is contemplated that it may be any type of projection, including a flat and substantially straight surface, a curved surface, and the like without departing from the scope or intent of the present disclosure.

In an advantageous aspect of the present disclosure, one or more tabs 210A may be retained within an interior portion of the receptacle body. Conventional devices to retain plugs may include pins and the like which secure to the plug on the exterior or outside of the receptacle body 110. However, such an arrangement reduces the number of receptacles that may be placed in a given area and makes insertion and removal of a plug more difficult as the pins and the like must be accounted for by a user during insertion of the plug and removal of the plug.

Figure 4:
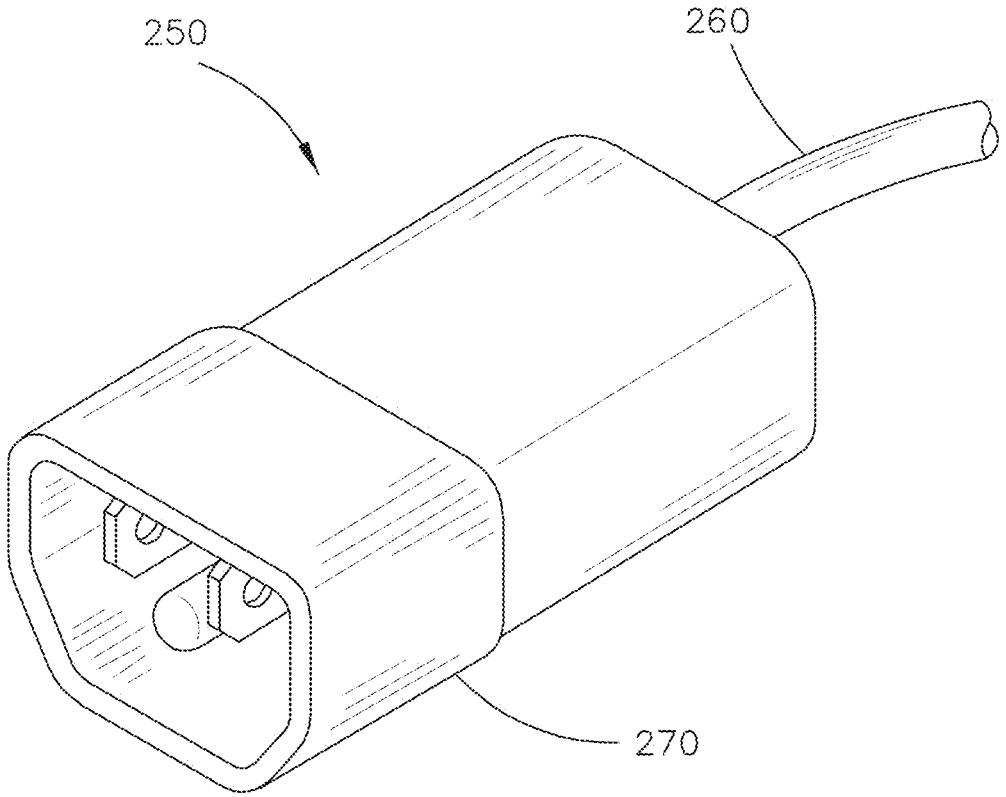
FIG. 4 depicts an exemplary plug which is retained in the apparatus for retaining a plug in accordance with an embodiment of the present disclosure.
Figure 5:
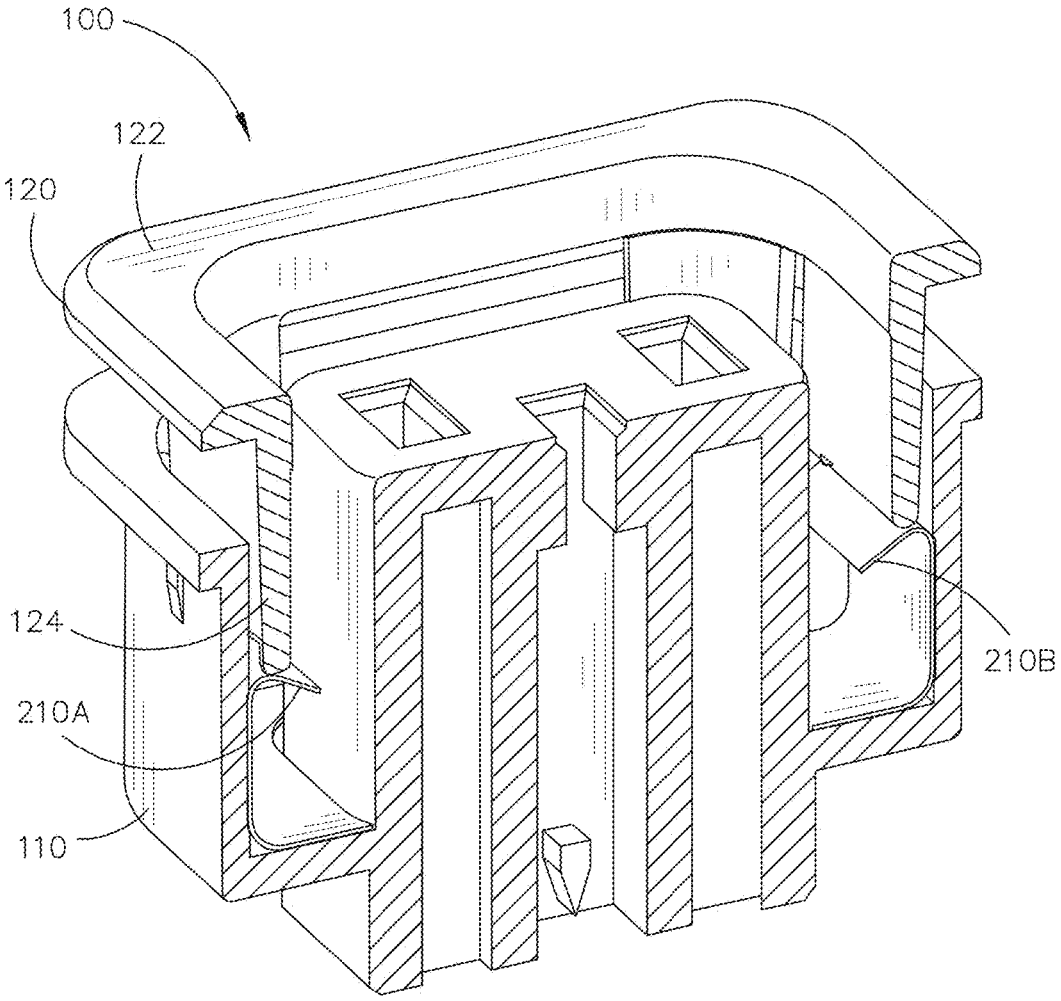
FIG. 5 depicts a cutaway view of the apparatus for retaining a plug in a receptacle in accordance with an alternative embodiment of the present disclosure.

Referring to FIG. 4, an exemplary plug 250 which is retained in the retaining apparatus in accordance with an embodiment of the present disclosure is shown. Plug 250 may include a male electrical fitting for making an electrical connection with a corresponding female fitting, such as a receptacle as shown in FIG. 5. It is contemplated that plug 250 may be electrically coupled with cable 260. Plug 250 may include a shroud 270. In an alternative embodiment, plug 250 may include a female electrical fitting as shown in FIG. 10 for making an electrical connection with a corresponding male fitting, such as an inlet mechanism as shown and described in FIG. 9. It is contemplated that apparatus for retaining a plug within a receptacle may be functional without any change or modification to the plug 250.

Figure 6:
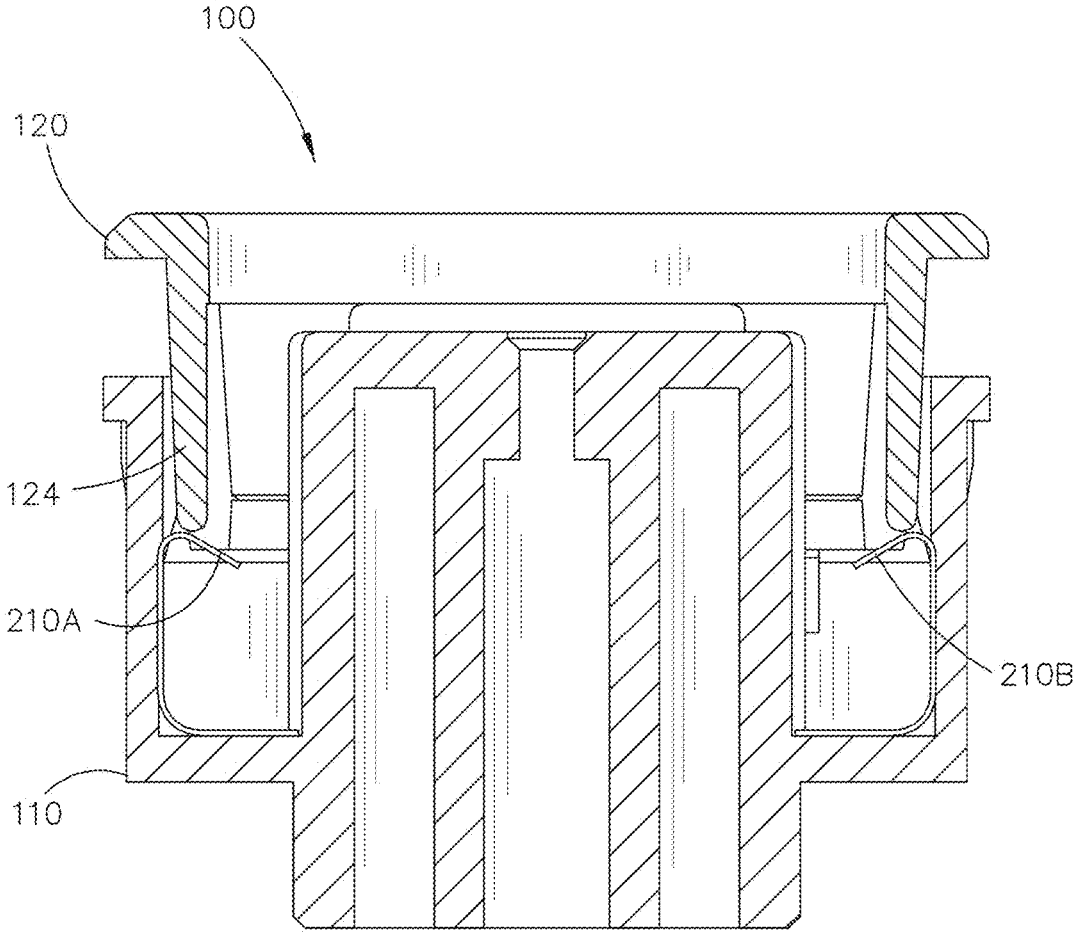
FIG. 6 depicts another cutaway view of the apparatus for retaining a plug in a receptacle in in accordance with an alternative embodiment of the present disclosure.

Referring to FIG. 5, a cutaway view of the apparatus for retaining a plug in a receptacle in accordance with an alternative embodiment of the present disclosure is shown. Apparatus 100 for retaining a plug may include a receptacle body 110. Receptacle body 110 may include at least one tab 210A, 210B. Tab 210A, 210B may be flexible, and may be formed of metal. When a plug is inserted into the receptacle body 110, the insertion of the plug may cause the at least one tab 210A, 210B to extend toward an exterior side of the receptacle body 110 while the at least one tab 210A, 210B remains in contact with the plug. It is contemplated that a plug (not shown in FIG. 5) may be retained within the receptacle body 110 by pressure applied by the at least one tab 210A, 210B to provide an interference fit or contact fit. To release a plug inserted within the receptacle body 110, the release device 120 is configured to be moved toward the interior of the receptacle body 110. The one or more prongs 124 of the release device 120 may contact the one or more tabs 210A, 210B to cause the one or more tabs 210A, 210B to extend away from the plug, at which point the plug may be removed from the receptacle body 110. FIG. 6 depicts another cutaway view of the apparatus for retaining a plug in a receptacle body 110 in accordance with an alternative embodiment of the present disclosure.

Figure 7:
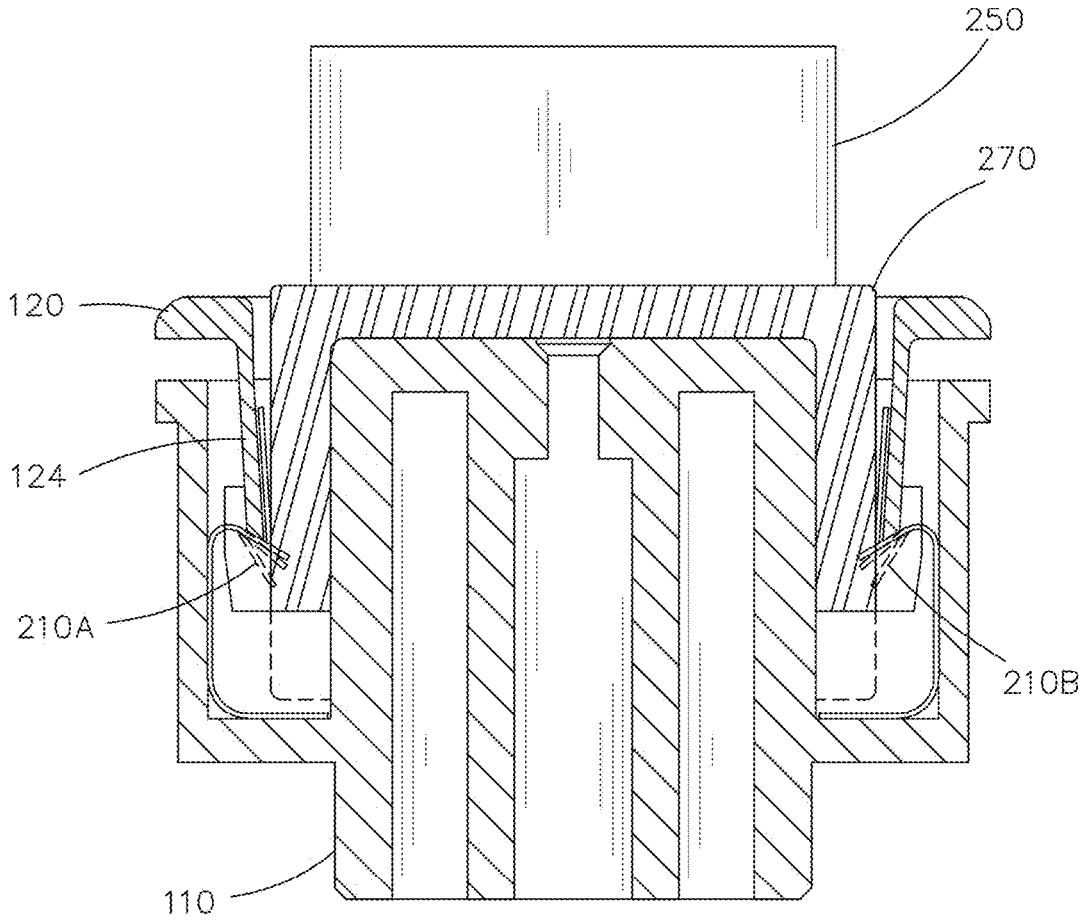
FIG. 7 depicts another cutaway view of the apparatus for retaining a plug in a receptacle with an inserted plug in accordance with an alternative embodiment of the present disclosure.

Referring to FIG. 7, another cutaway view of the apparatus for retaining a plug in a receptacle body 110 with an inserted plug in accordance with an alternative embodiment of the present disclosure is shown. Receptacle body 110 may retain a plug 250 with a shroud 270 by pressure applied by the at least one tab 210A, 210B to provide an interference fit or contact fit. To release plug 250 inserted within the receptacle body 110, the release device 120 is configured to be moved toward the interior of the receptacle body 110. The one or more prongs 124 of the release device 120 may contact the one or more tabs 210A, 210B to cause the one or more tabs 210A, 210B to extend away from the plug 250, at which point the plug 250 may be removed from the receptacle body 110. It is contemplated that the one or more prongs 124 may contact the one or more tabs 210A to reduce the pressure applied by the one or more tabs 210A, 210B and may or may not remain in slight contact with the plug 250. However, with the reduced pressure applied by the one or more tabs 210A, 210B, plug 250 may be easily removed from the receptacle body 110.

Figure 8A:
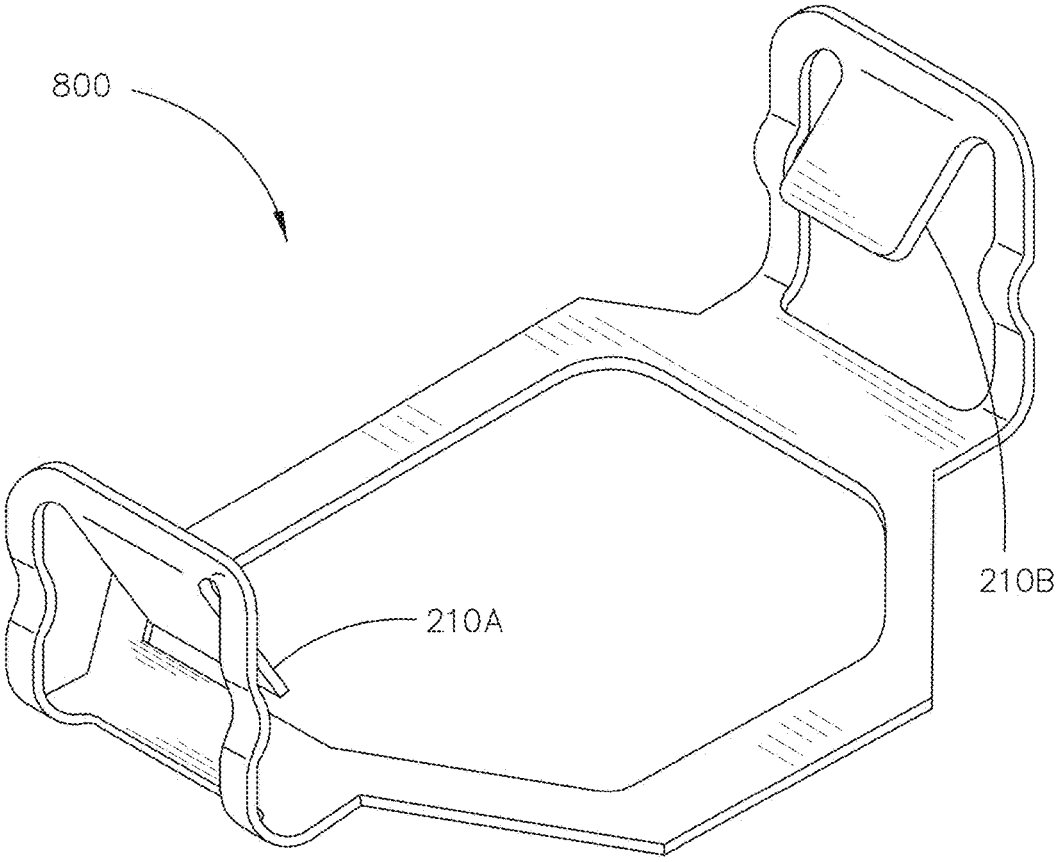
FIGS. 8A, 8B, and 8C depict a tab assembly including two tabs for placement within a receptacle body in accordance with an embodiment of the present disclosure.
Figure 8B:
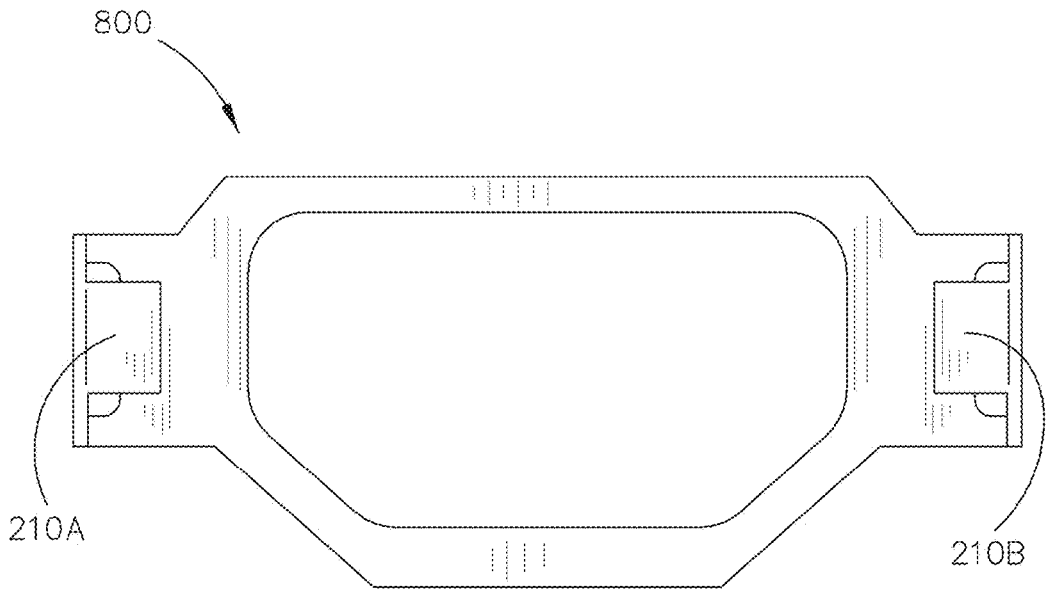
Figure 8C:
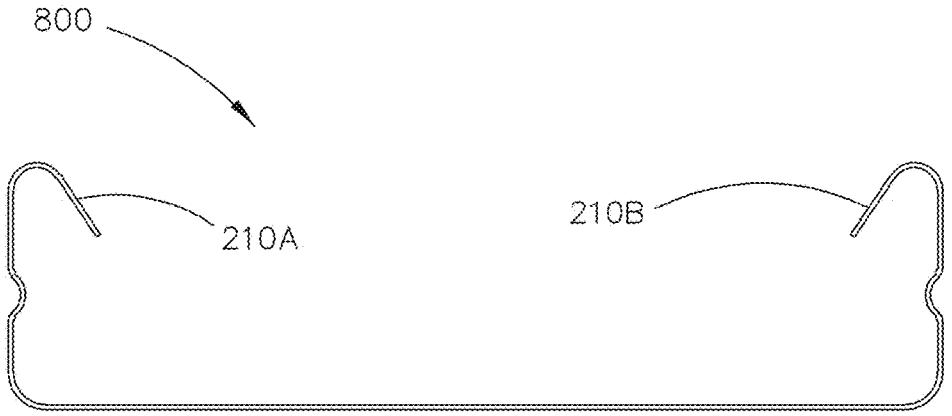

Referring to FIGS. 8A, 8B, and 8C, a tab assembly 800 including two tabs 210A, 210B for placement within a receptacle body in accordance with an embodiment of the present disclosure is shown. Tab assembly 800 may include a ring portion with a first tab 210A and a second tab 210B on opposing sides of the tab assembly 800. It is contemplated that tab assembly 800 may be formed of metal. It is further contemplated that tab assembly 800 may be located within a base of receptacle body 110 as shown in FIGS. 5-7. Advantageously, the incorporation of tab assembly 800 with receptacle body 110 may reduce manufacturing costs while maintaining a retention capability. While tab assembly 800 is shown with a first tab 210A and a second tab 210B, it is contemplated that tab assembly 800 may be employed with one, three, or four or more tabs without departing from the scope and intent of the present disclosure.

Figure 9:
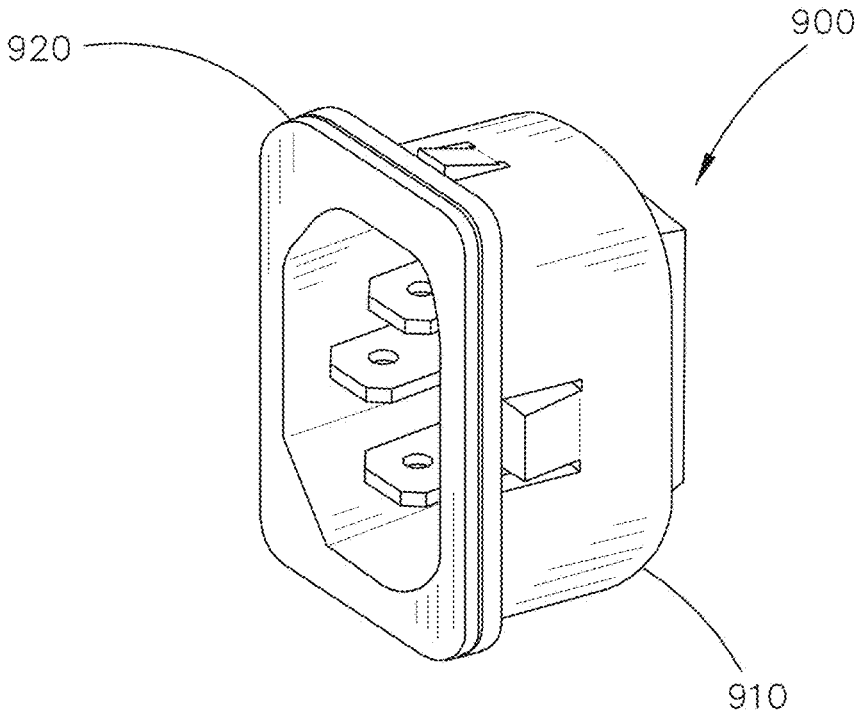
FIG. 9 depicts an apparatus for retaining a connector in an inlet mechanism in accordance with an embodiment of the present disclosure.
Figure 10:
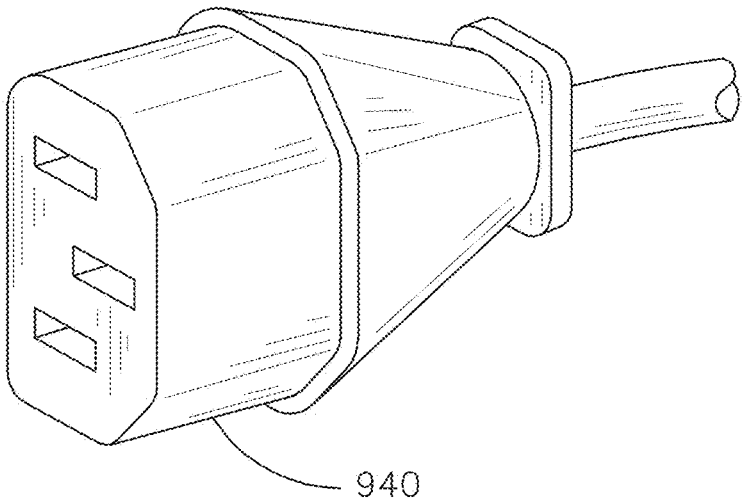
FIG. 10 depicts an exemplary connector which is retained in a retaining apparatus in accordance with an embodiment of the present disclosure.

Referring to FIG. 9 and FIG. 10, an apparatus 900 for retaining a connector 940 in an inlet mechanism 910 in accordance with an embodiment of the present disclosure is shown. Inlet mechanism 910 may be a receptacle that may include a male electrical fitting, including male pins. Release device 120 may operate with inlet mechanism 910 to retain a corresponding female electrical fitting, such as connector 940 as shown in FIG. 10. It is contemplated that at least one tab (not shown in FIG. 9) of the inlet mechanism 910 may contact and retain a shroud of connector 940 whereby the inlet mechanism 910 may operate in a similar fashion as receptacle body 110 to retain a plug 250 within the receptacle body 110 as shown and described in FIGS. 1-3 and 5-7.

Figure 11:
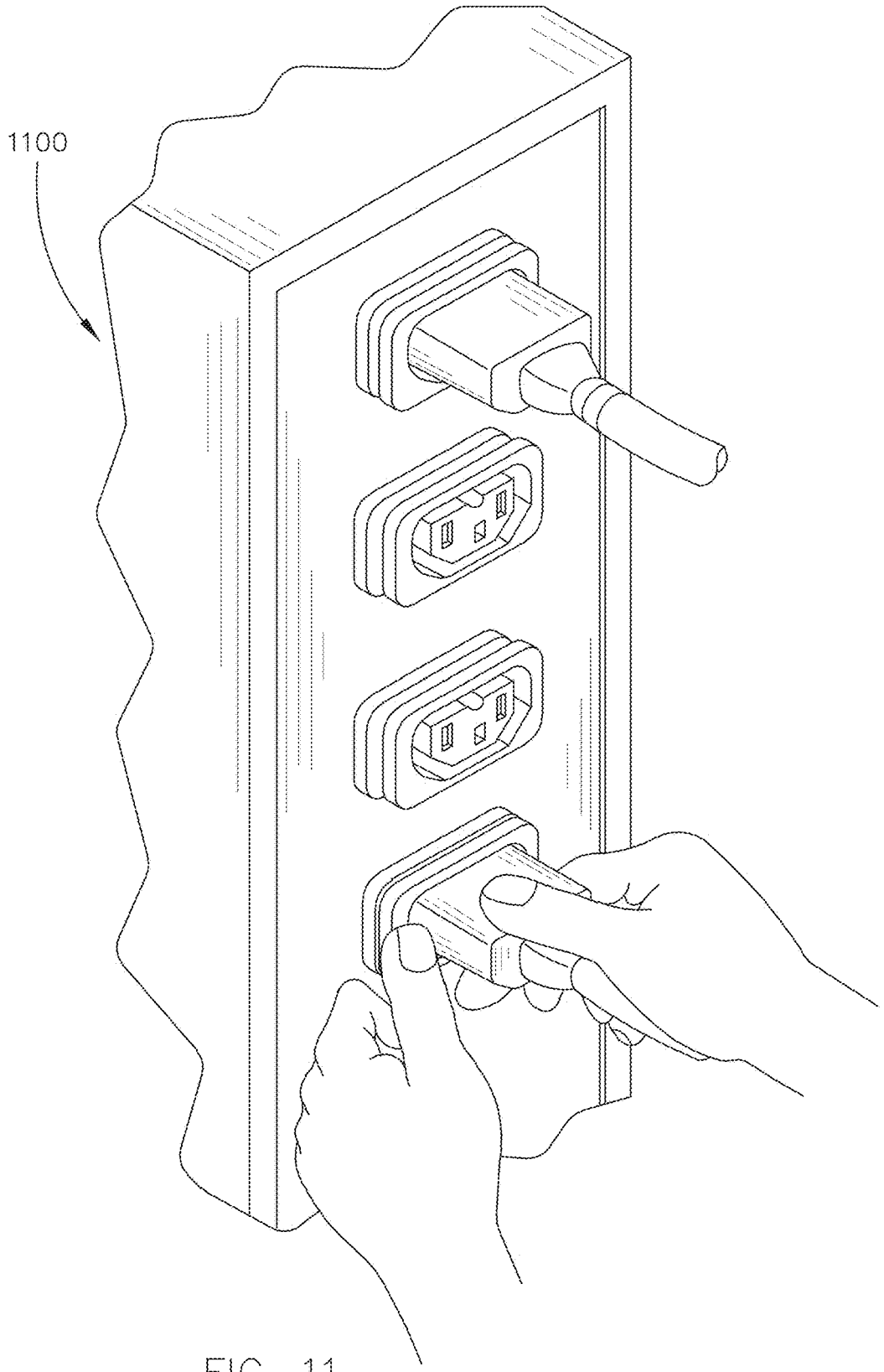
FIG. 11 depicts a power strip including an apparatus for retaining a plug in a receptacle in accordance with an embodiment of the present disclosure.

Referring to FIG. 11, a power strip 1100 including an apparatus for retaining a plug in a receptacle in accordance with an embodiment of the present disclosure is shown. Power strip 1100 may include a plurality of receptacles which supply power to a plurality of electronic devices. It is contemplated that multiple apparatuses 100 for retaining a plug may be employed in a power strip 1100 to prevent unintended disconnection of a plug from a receptacle. FIG. 11 also shows a user may press the release device 120 and cause the release device 120 to be moved toward the interior of the receptacle body 110 whereby the one or more tabs of the receptacle body 110 may be extended away from a plug to allow removal of a plug.

Figure 12:
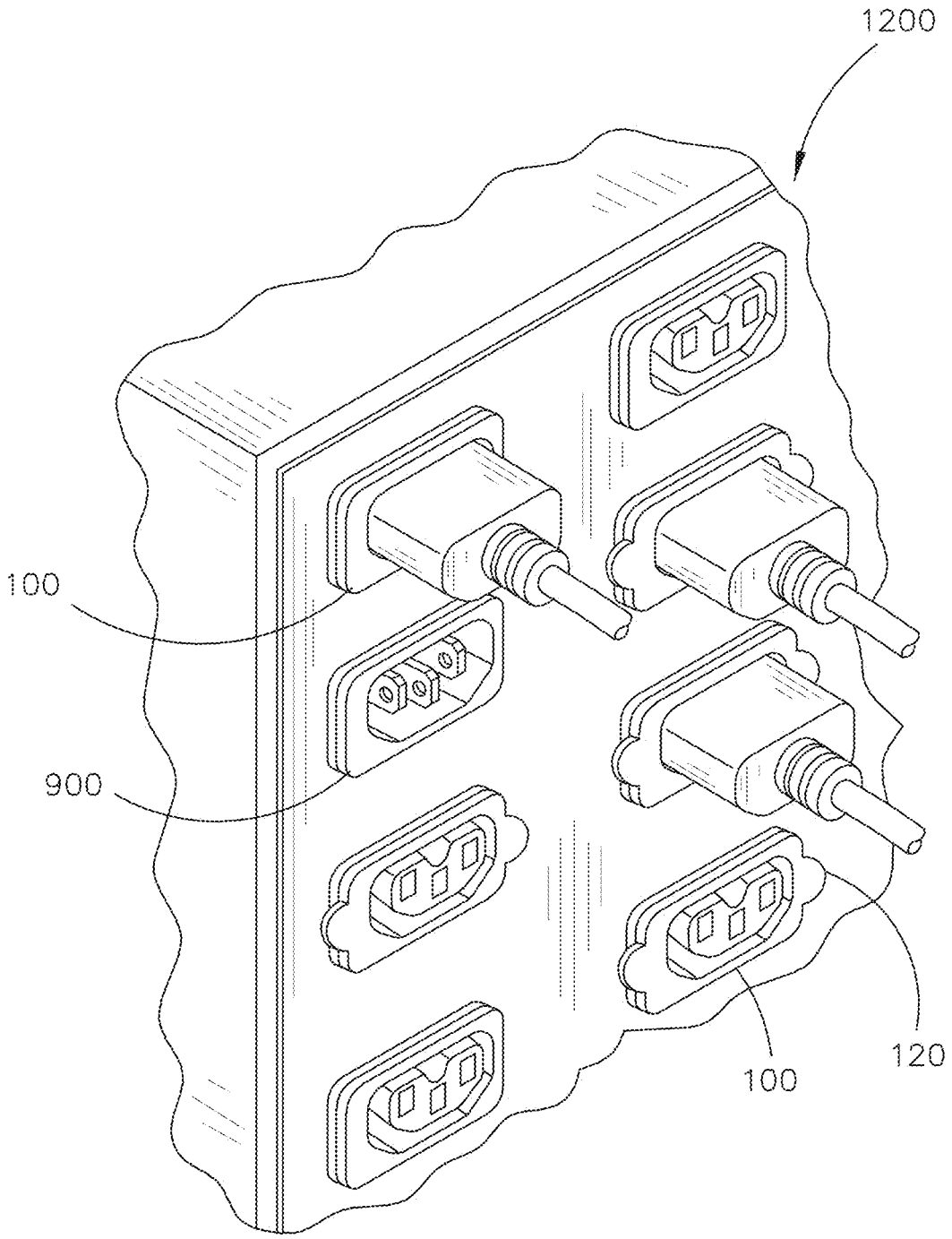
FIG. 12 depicts a power strip including an apparatus for retaining a plug in a receptacle and an apparatus for retaining a connector in an inlet mechanism in accordance with an embodiment of the present disclosure.

Referring to FIG. 12, a power strip 1200 may include an apparatus 100 for retaining a plug in a receptacle and an apparatus 900 for retaining a connector in an inlet mechanism in accordance with an embodiment of the present disclosure is shown. It is contemplated that multiple apparatuses 100, 900 may be employed in a power strip 1200 to prevent unintended disconnection of a plug or connector. It is contemplated that face portion of release device 120 may include one or more protrusions. One or more protrusions may extend from the face portion and may allow easier finger access to the release device to allow removal of a plug.

It is contemplated that apparatus 100, 900 may provide many advantages over locking receptacles known to the conventional art. Conventional locking receptacles may include specialized receptacles or specialized plugs. Specialized receptacles and specialized plugs create additional costs and reduce the flexibility to change power cords in a large scale electrical power distribution system, such as power strips employed in a data center providing power to multiple data servers. Advantageously, apparatus 100, 900 may be operable with power cords supplied by the manufacturers of electronic equipment, such as data servers.

It is contemplated that apparatus 100, 900 may be operable with IEC 60320 couplers, referring to a list of standards from the International Electrotechnical Commission specifying non-locking appliance couplers and interconnection couplers for the connection of power supply cords to electrical appliances up to 250 Volts, including C13, C15, C19 and C21 receptacles. Additionally, it is contemplated that apparatus 100 may be operable with any type of plug that includes a shroud that may cover at least a portion of the pins of the plug. Also, the apparatus 900 may be operable with a female coupler with any type of shroud.

It is contemplated that apparatus 100, 900 may be more effective than conventional devices for retaining plugs. There are required manufacturing tolerances which must be passed in order to comply with the International Electrotechnical Commission standards for specifying non-locking appliance couplers and interconnection couplers for the connection of power supply cords to electrical appliances up to 250 Volts, including C13, C15, C19 and C21 receptacles. As the apparatus 100, 900 is configured to contact sides of a shroud of a plug, and dimensions of the shroud must be within manufacturing compliance, apparatus 100, 900 operates with an increased level of performance than conventional devices for retaining plugs.

An additional advantage of the apparatus 100, 900 may include the ability to employ labels and different colors. By adding an identifier such as color or a label to the face portion 122 of the release device 120, particular receptacles may be more easily identified and separated, particularly when implemented with a power strip 1100, 1200 as depicted in FIG. 11 and FIG. 12.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. An apparatus for retaining a plug within a receptacle, comprising:

a receptacle body, the receptacle body including at least one tab configured to make contact with a plug when the plug is inserted within the receptacle body, the at least one tab is located within an interior of the receptacle body; and a release device disposed within the receptacle body, the release device including a face portion and at least one prong, wherein the release device is configured to allow the face portion to be depressed and cause the at least one prong to come into contact with the at least one tab in order to allow the plug to be removed from the receptacle body.

2. The apparatus as claimed in claim 1, wherein the receptacle body includes a receptacle.

3. The apparatus as claimed in claim 2, wherein said receptacle includes a female electrical fitting.

4. The apparatus as claimed in claim 3, wherein said plug includes a male electrical fitting.

5. The apparatus as claimed in claim 2, wherein said receptacle includes a male electrical fitting.

6. The apparatus as claimed in claim 5, wherein said plug includes a female electrical fitting.

7. The apparatus as claimed in claim 1, wherein the at least one tab is formed of plastic.

8. The apparatus as claimed in claim 7, wherein the at least one tab includes at least one barb.

9. The apparatus as claimed in claim 1, wherein the at least one tab is formed of metal.

10. The apparatus as claimed in claim 1, wherein the at least one tab is part of a tab assembly, the tab assembly including a ring located in a base of the receptacle body with a first tab and a second tab on opposing sides of the tab assembly.

11. An apparatus for retaining a plug within a receptacle, comprising:

a receptacle body, the receptacle body including a tab assembly including a ring located in a base of the receptacle body with a first tab and a second tab on opposing sides of the tab assembly, the first tab and the second tab configured to make contact with a plug when the plug is inserted within the receptacle body, the first tab and the second tab located within an interior of the receptacle body; and a release device disposed within the receptacle body, including a face portion and at least two prongs, wherein the release device is configured to allow the face portion to be depressed to cause a first prong to come into contact with the first tab and a second prong to come into contact with the second tab and extend the first tab and the second tab away from the plug to allow the plug to be released from the receptacle body.

12. The apparatus as claimed in claim 11, wherein the receptacle body includes a receptacle.

13. The apparatus as claimed in claim 12, wherein said receptacle includes a female electrical fitting.

14. The apparatus as claimed in claim 13, wherein said plug includes a male electrical fitting.

15. The apparatus as claimed in claim 12, wherein said receptacle includes a male electrical fitting.

16. The apparatus as claimed in claim 15, wherein said plug includes a female electrical fitting.

17. An apparatus for retaining a plug within a receptacle, comprising:

a receptacle body, the receptacle body including a tab assembly formed of metal, the tab assembly including a ring located in a base of the receptacle body with a first tab and a second tab on opposing sides of the tab assembly, the first tab and the second tab configured to make contact with a plug when the plug is inserted within the receptacle body, the first tab and the second tab located within an interior of the receptacle body; and a release device disposed within the receptacle body, including a face portion and at least two prongs, wherein the release device is configured to allow the face portion to be depressed to cause a first prong to come into contact with the first tab and a second prong to come into contact with the second tab and extend the first tab and the second tab away from the plug to allow the plug to be released from the receptacle body.

18. The apparatus as claimed in claim 17, wherein the receptacle body includes a receptacle.

* * * * *